US007217014B2

(12) United States Patent
Nielson

(10) Patent No.: US 7,217,014 B2
(45) Date of Patent: May 15, 2007

(54) INTERCHANGEABLE ADORNMENTS FOR CHANDELIERS AND THE LIKE

(75) Inventor: Colleen Nielson, Westlake Village, CA (US)

(73) Assignee: Magificent Trimmings, Inc., Vista, CA (US)

( * ) Notice: Subject to any disclaimer, the term of this patent is extended or adjusted under 35 U.S.C. 154(b) by 173 days.

(21) Appl. No.: 10/782,607

(22) Filed: Feb. 19, 2004

(65) Prior Publication Data

US 2004/0160779 A1 Aug. 19, 2004

Related U.S. Application Data

(60) Provisional application No. 60/448,288, filed on Feb. 19, 2003.

(51) Int. Cl.
*F21S 8/06* (2006.01)
*F21V 21/00* (2006.01)

(52) U.S. Cl. ..... 362/405; 362/398

(58) Field of Classification Search ..... 362/405
See application file for complete search history.

(56) References Cited

U.S. PATENT DOCUMENTS 5,655,308 A * 8/1997 McDermott ..... 362/205
6,010,235 A * 1/2000 Sawyer ..... 362/398
6,079,855 A * 6/2000 Azeredo et al. ..... 362/356
6,241,370 B1 * 6/2001 Bayer et al. ..... 362/405
6,663,259 B2 * 12/2003 Westfall ..... 362/249
6,712,490 B2 * 3/2004 Bayer ..... 362/405

* cited by examiner

*Primary Examiner*—Ali Alavi
*Assistant Examiner*—William J Carter
(74) *Attorney, Agent, or Firm*—Duane Morris LLP

(57) ABSTRACT

A reconfigurable chandelier includes fixed components and a plurality of removable and interchangeable decorative adornments. The adornments each include at least one magnet that magnetically couples the adornment to a portion of the chandelier. Some or all of the set of interchangeable adornments may be interchanged to provide the chandelier with a different appearance. The adornments may be of different shapes, sizes, and colors. The adornments may include multiple pieces coupled together and to the magnet using wire, string, chain or metal links. The chandelier may be easily disassembled and reassembled by removing and replacing the adornments for cleaning or to change the appearance of the chandelier.

12 Claims, 10 Drawing Sheets

INTERCHANGEABLE ADORNMENTS FOR CHANDELIERS AND THE LIKE

RELATED APPLICATIONS

This application claims priority of U.S. Provisional Application Ser. No. 60/448,288, entitled REMOVABLE ADORNMENTS FOR CHANDELIERS AND THE LIKE, filed on Feb. 19, 2003.

BACKGROUND OF THE INVENTION

Chandeliers are decorative branched light fixtures that add elegance to a room. Chandeliers are commonly adorned with crystal prisms or other decorative components. Conventional chandeliers, whether simple or elaborate, are arranged in a fixed configuration and therefore include an unchanging appearance. Chandeliers may be metal/iron based and include a number of metal surfaces. Chandeliers are often costly and it would be cost prohibitive to maintain multiple chandeliers having different appearances or configurations in order to provide different décor to a setting.

In order to enhance the versatility of a chandelier and provide a changeable décor, it would be advantageous and desirable to quickly and simply change the appearance and/or configuration of a chandelier without requiring an exhaustive and time-consuming disassembly and reassembly process as would typically be required to replace components of the chandelier. Changing the position of components of a chandelier would require drilling holes through metal or other hardware of the chandelier. Such a process would be time-consuming, exhaustive and frustrating.

The above considerations are similarly true for other household fixtures, appliances and furnishings that may include various adornments and would benefit from having a versatile appearance. Such fixtures, appliances and furnishings include candelabras, candle holders, ceiling fans, strip lighting, sconces, bobeshes, lampshades, lamps and various overhead lighting fixtures, for example. It would be advantageous to change the appearance of such fixtures, appliances and furnishings simply and quickly without replacing the entire unit or undertaking the elaborate disassembly and reassembly process to enhance the versatility of the unit. Changing the appearance in a simple and quick fashion would be especially useful for fixtures that are difficult to access, such as fixtures suspended overhead, and that would require a person to ascend a ladder and/or to work in an awkward position.

Chandeliers and other overhead fixtures and appliances that are typically hung from a ceiling, are also difficult to clean as a person must ascend and remain high above the floor on a ladder or other platform to either clean individual components of the chandelier while still attached to the body of the fixture and in close proximity to other components or disassemble the chandeliers' trimmings such as crystal prisms or other decorative components, which involves an intricate and time-consuming process. It would therefore be desirable to be able to clean a chandelier without requiring a person to remain at the height of the chandelier for an extended period of time to either perform the cleaning operation or to disassemble and reassemble the chandelier components. Moreover, it would be especially desirable to clean a chandelier without requiring a person to ascend to the height of the chandelier at all. Even for fixtures, appliances and furnishings not suspended overhead, it is generally desirable to individually clean detached components separately, rather than cleaning an assembled unit or requiring the elaborate and time-consuming disassembly and reassembly process.

It would therefore be desirable to provide a chandelier and other fixtures, appliances and furnishings that can simply and easily be disassembled and reassembled for cleaning, as well as reconfigured to provide a different appearance. The present invention addresses these and other needs.

SUMMARY OF THE INVENTION

To achieve these and other objects, and in view of its purposes, the present invention provides a reconfigurable apparatus comprising one of a household lighting apparatus and a home accessory that includes at least one fixed component and a plurality of removable adornments, each removable adornment including a magnet and being magnetically coupled to a portion of the apparatus.

In another embodiment, the present invention provides a reconfigurable decorative lighting unit such as a chandelier comprising a plurality of fixed components and a plurality of interchangeable decorative adornments, each including a magnet and being magnetically coupled to a portion of the chandelier. The plurality of removable adornments may comprise a first set of removable adornments that provide a first appearance and the reconfigurable chandelier may further comprise a second set of removable adornments magnetically engageable with the chandelier to provide a second appearance.

In another embodiment, the present invention provides a method for cleaning a decorative lighting unit comprising providing a decorative lighting unit with a plurality of removable adornments, each including a magnet and magnetically coupled to the decorative lighting unit, removing the plurality of removable adornments by pulling to disengage the magnet, cleaning the plurality of removable adornments and recoupling the plurality of removable adornments to the decorative lighting unit.

In another embodiment, the present invention provides a method for changing the appearance of a chandelier. The method comprises providing a chandelier with a plurality of removable adornments, each including a magnet and magnetically coupled to the chandelier, removing at least one of the removable adornments by disengaging the magnet, replacing the removed adornment or adornments with a corresponding further magnetic adornment or adornments, and magnetically coupling the further magnetic adornment or adornments to the chandelier.

In another embodiment, the present invention provides an interchangeable decorative adornment for attachment to reconfigurable decorative lighting units comprising an interchangeable adornment including at least one decorative portion and a magnet and being magnetically attachable to a plurality of corresponding metal portions of at least one decorative lighting unit.

BRIEF DESCRIPTION OF THE DRAWINGS

The present invention is best understood from the following detailed description when read in conjunction with the accompanying drawing. It is emphasized that, according to common practice, various features of the drawing are not necessarily to scale. On the contrary, the dimensions of the various features are arbitrarily expanded or reduced for clarity to aid in illustrating aspects of the invention. Like numerals denote like features throughout the specification and drawing. Including in the drawing are the following figures.

DETAILED DESCRIPTION OF THE INVENTION

Figure 1:
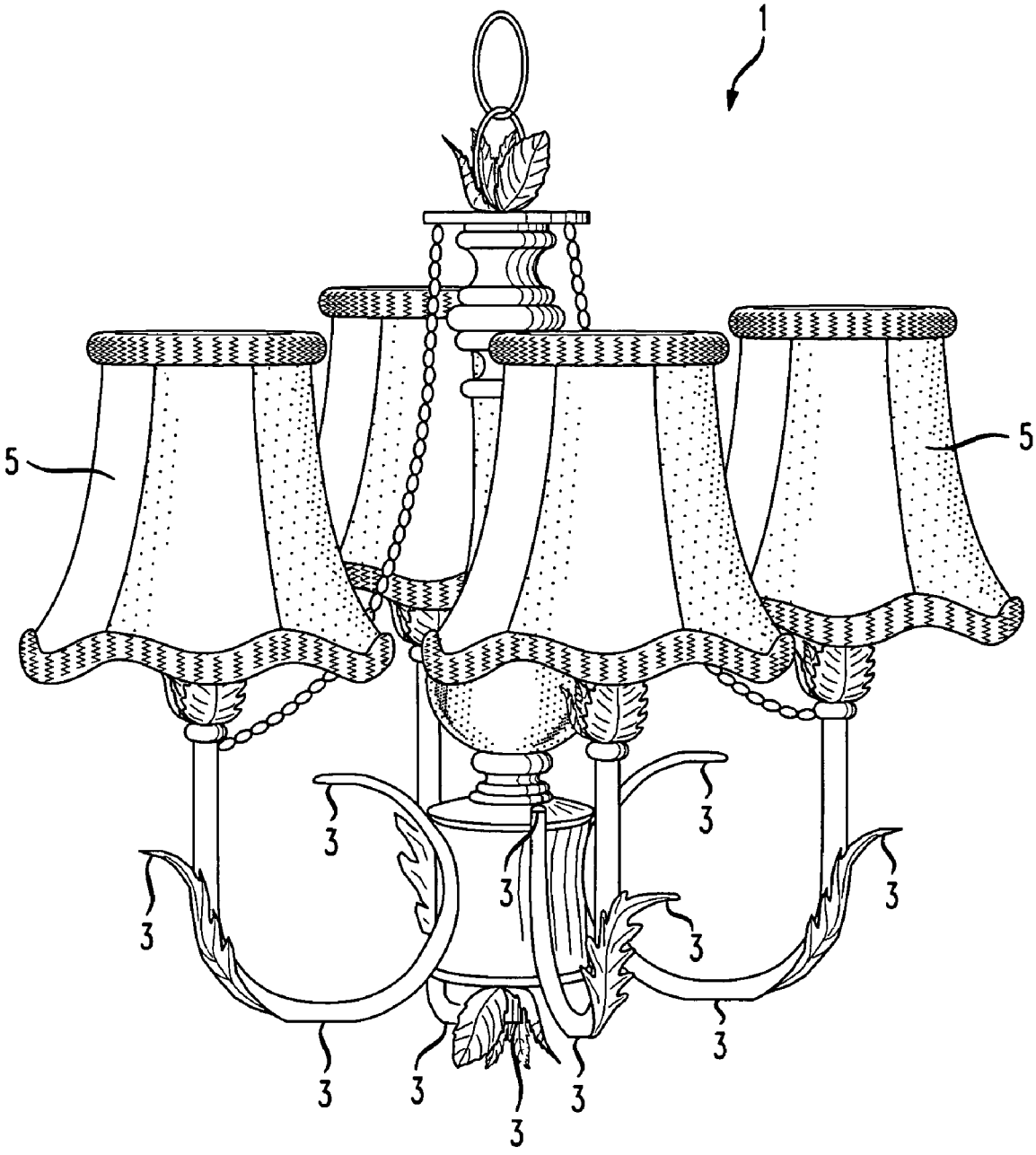
FIG. 1 illustrates an exemplary arrangement of a reconfigurable chandelier according to the present invention.

In one embodiment, the present invention provides a chandelier with easily removable and interchangeable portions. The removable/interchangeable portions are magnetically coupled adornments that combine with other features to shape and decorate the chandelier. One aspect of the present invention is that the magnetically coupled adornments can be disengaged from the chandelier by simply pulling the magnetic adornment from the fixture by hand or by using any of various grasping tools. The adornments can then be cleaned and easily restored to their original positions, using various grasping tools or by hand. When not coupled to a chandelier or the like, the uncoupled interchangeable magnetic adornments of the present invention, which include a magnet or magnets, may be considered magnetically engageable adornments. Hereinafter, the adornments of the present invention will be referred to as interchangeable magnetic adornments.

Another aspect of the present invention is that the interchangeable magnetic adornments may be rearranged, removed, or replaced with a different set of interchangeable magnetic adornments, thereby changing the configuration and appearance of the chandelier. In this manner, a chandelier with interchangeable portions, i.e., a reconfigurable chandelier, is produced. The original set of adornments may be replaced with a completely new set of adornments having different shapes, different sizes, different configurations, and/or different colors. In another embodiment, one or some of the original set of adornments may be replaced with a corresponding adornment or adornments. Each set of interchangeable magnetic adornments provides a unique appearance to the chandelier and within each set of adornments, there may be adornments having different shapes, different sizes, different configurations and/or different colors. The adornments within a set may be rearranged and positioned at different locations that include a metal surface adapted to engage the magnet. The interchangeable magnetic adornments may be formed of various different materials and may include various designs and styles. They may include a single piece coupled to a magnet or multiple pieces coupled together and to a magnet.

According to one exemplary embodiment, the interchangeable magnetic adornments may be of a particular color or colors, shapes, or figures associated with a particular season, holiday or occasion. For example, the adornments may include a Santa Claus, reindeer, or snowman figurine for the Christmas holidays. In another embodiment, the adornments may include flowers or other decorative pieces suitable for a special occasion, such as a wedding (e.g. wedding bells). It can be understood that the decorative adornments may be customized for other holidays, seasons, moods, or occasions. According to yet another exemplary embodiment, the interchangeable magnetic adornments may be of a functional value, in addition to or instead of decorative. For example, interchangeable magnetic adornments of a particular shape or color may be used to enhance a setting's décor and/or appearance of illumination. They may alternatively or additionally be used to direct or reflect light in a particular manner.

FIG. 1 shows an exemplary chandelier 1 including fixed portions such as light sources 5. Chandelier 1 also includes a plurality of receiving locations 3 that are metallic surfaces to which a magnet may be coupled. The receiving locations 3 may be considered a plurality of surfaces to which magnets may be coupled or the chandelier may be considered to have a continuous metal receiving surface on which a plurality of adornments may be attached at various arbitrary locations. Receiving locations 3 are intended to be arbitrary only and the magnetic adornments of the present invention may be coupled at any suitable location to a metallic surface that will receive the magnet. Receiving locations 3 may be smooth or irregular surfaces or other metallic shapes capable of receiving and engaging a suitable magnet.

Figure 2:
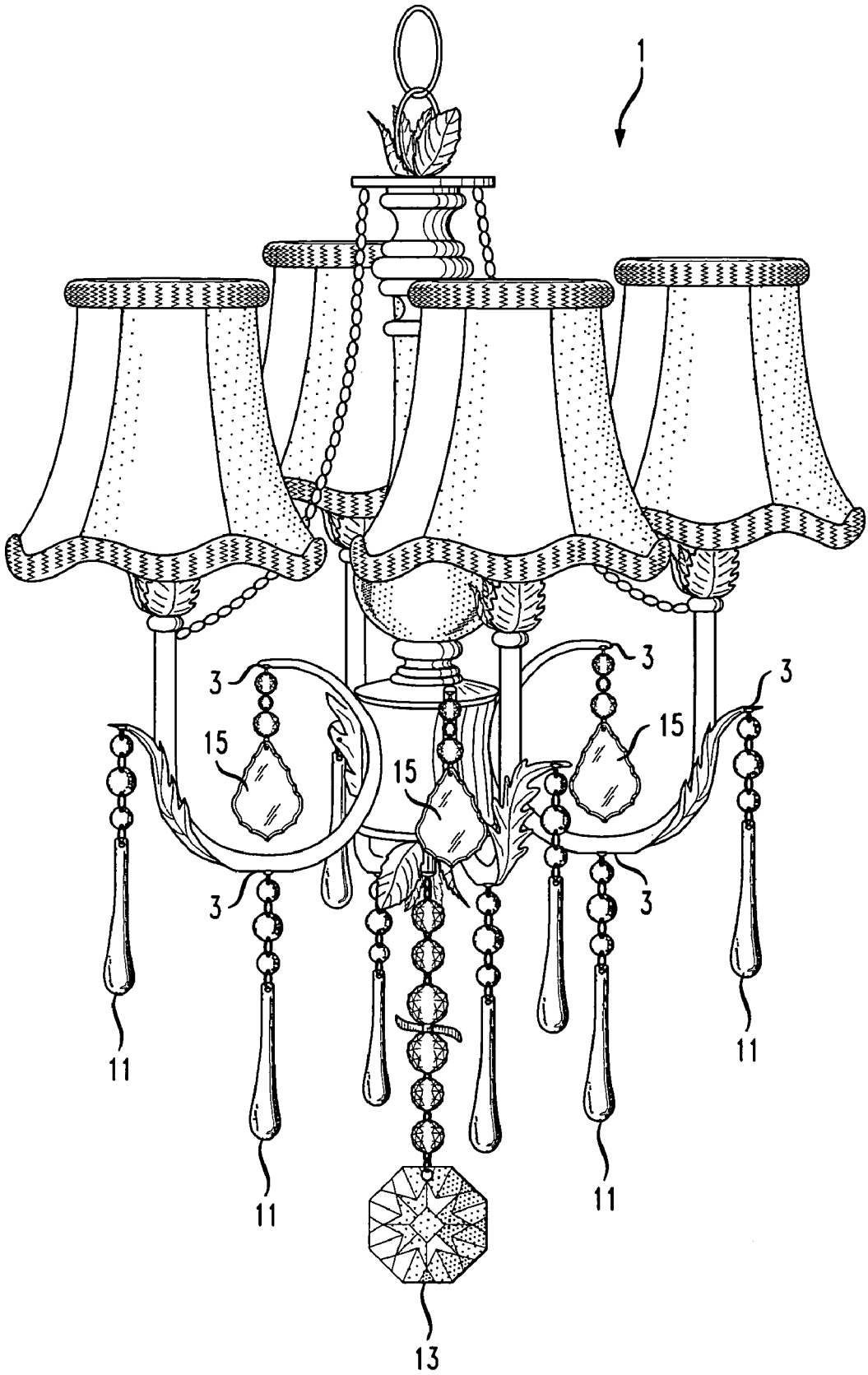
FIG. 2 illustrates an exemplary arrangement of the reconfigurable chandelier with interchangeable magnetic adornments according to the present invention.
Figure 3:
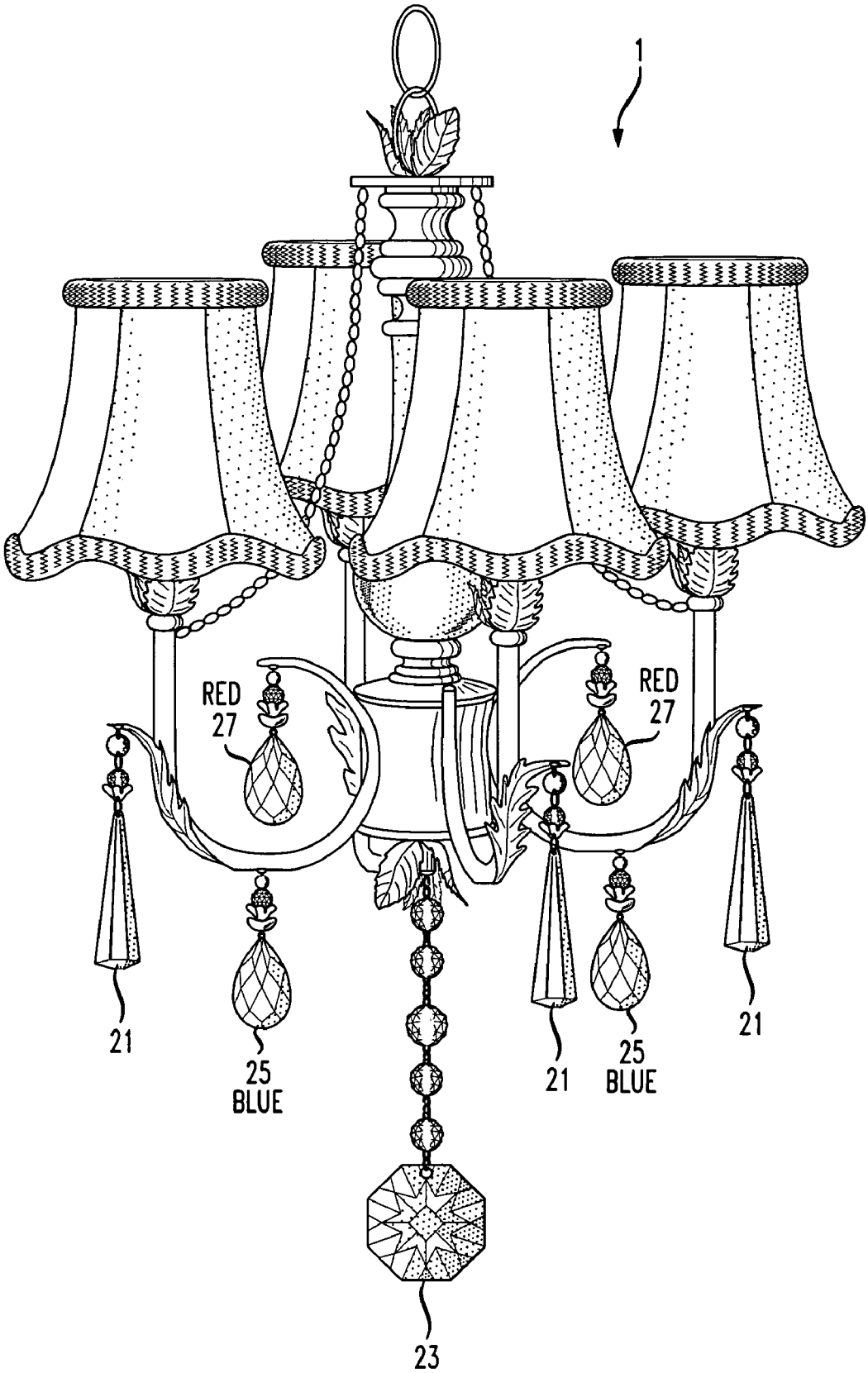
FIG. 3 illustrates another exemplary arrangement of the reconfigurable chandelier with interchangeable magnetic adornments according to the present invention.
Figure 4:
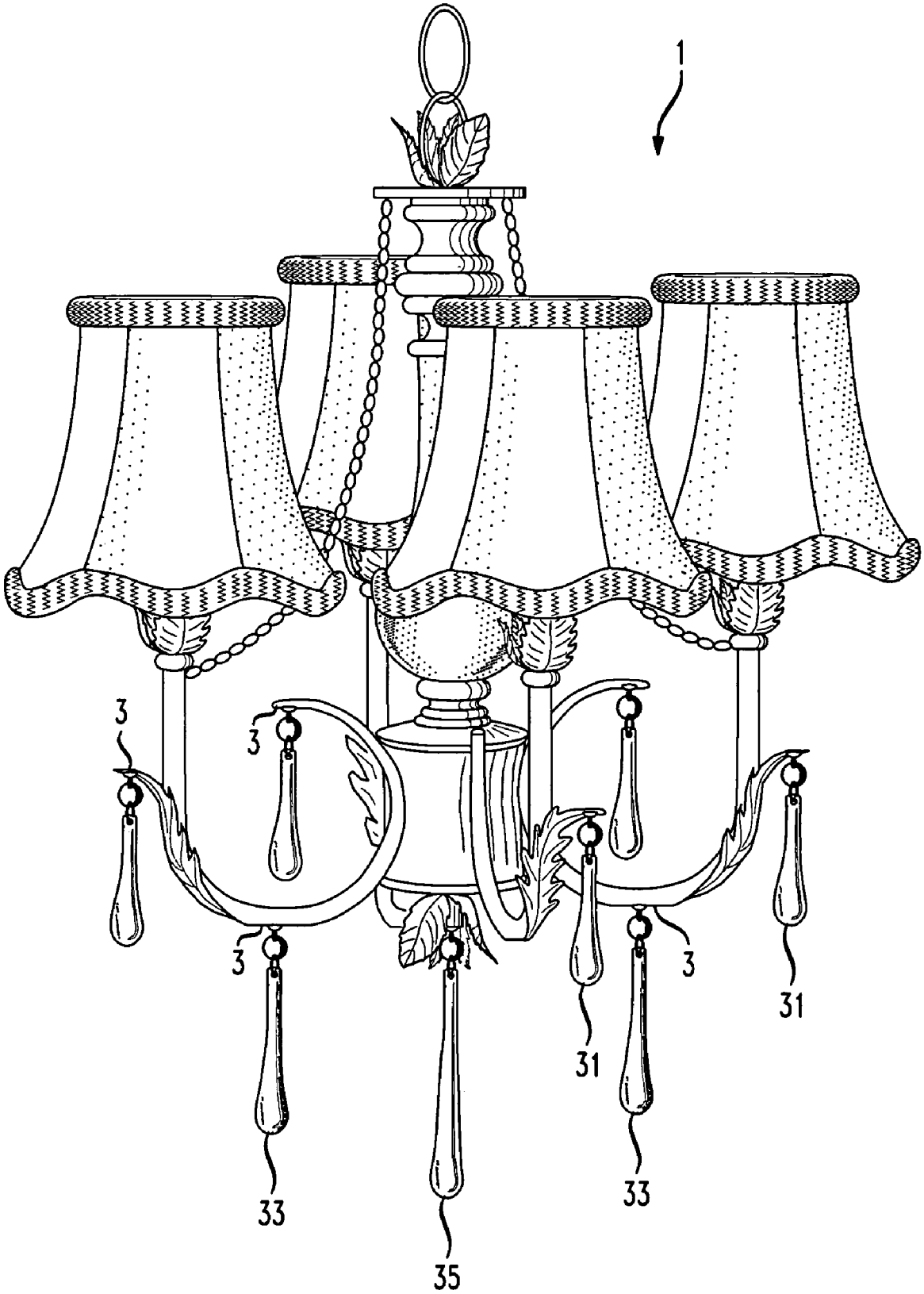
FIG. 4 illustrates yet another exemplary arrangement of the reconfigurable chandelier with interchangeable magnetic adornments according to the present invention.
Figure 5:
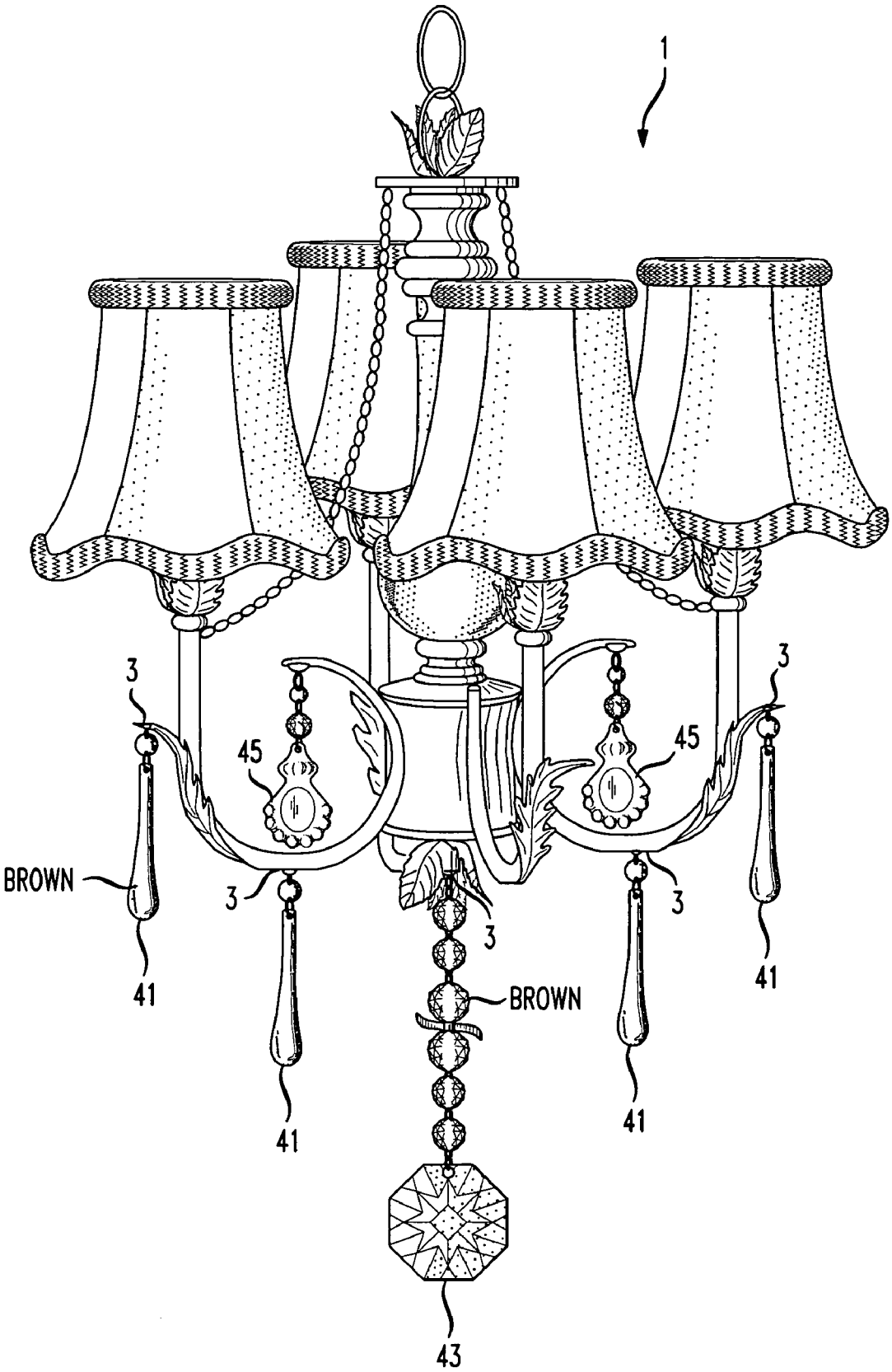
FIG. 5 illustrates still another exemplary arrangement of the reconfigurable chandelier with interchangeable magnetic adornments according to the present invention.

FIG. 2 shows chandelier 1 shown in FIG. 1 with a plurality of interchangeable magnetic adornments 11, 13 and 15 magnetically coupled to receiving locations 3 of chandelier 1. It can be seen that adornments 11, 13 and 15 differ from one another in shape, style, size and color. Further details of the various interchangeable magnetic adornment embodiments will be shown in FIGS. 8–12. FIG. 3 shows the chandelier 1 shown in FIGS. 1 and 2 with a different plurality of adornments 21, 23, 25 and 27. It can been seen that the adornments vary in shape, size and color (e.g., the lowermost portion of adornment 25 is blue whereas the lowermost portion of adornment 27 is red). FIG. 4 shows the same exemplary chandelier 1 with a further plurality of adornments 31, 33 and 35. Adornments 31, 33 and 35 are of substantially the same style but are of different lengths. FIG. 5 shows yet another exemplary arrangement of reconfigurable chandelier 1 that includes a plurality of adornments 41, 43 and 45 which each differ from one another.

Figure 6:
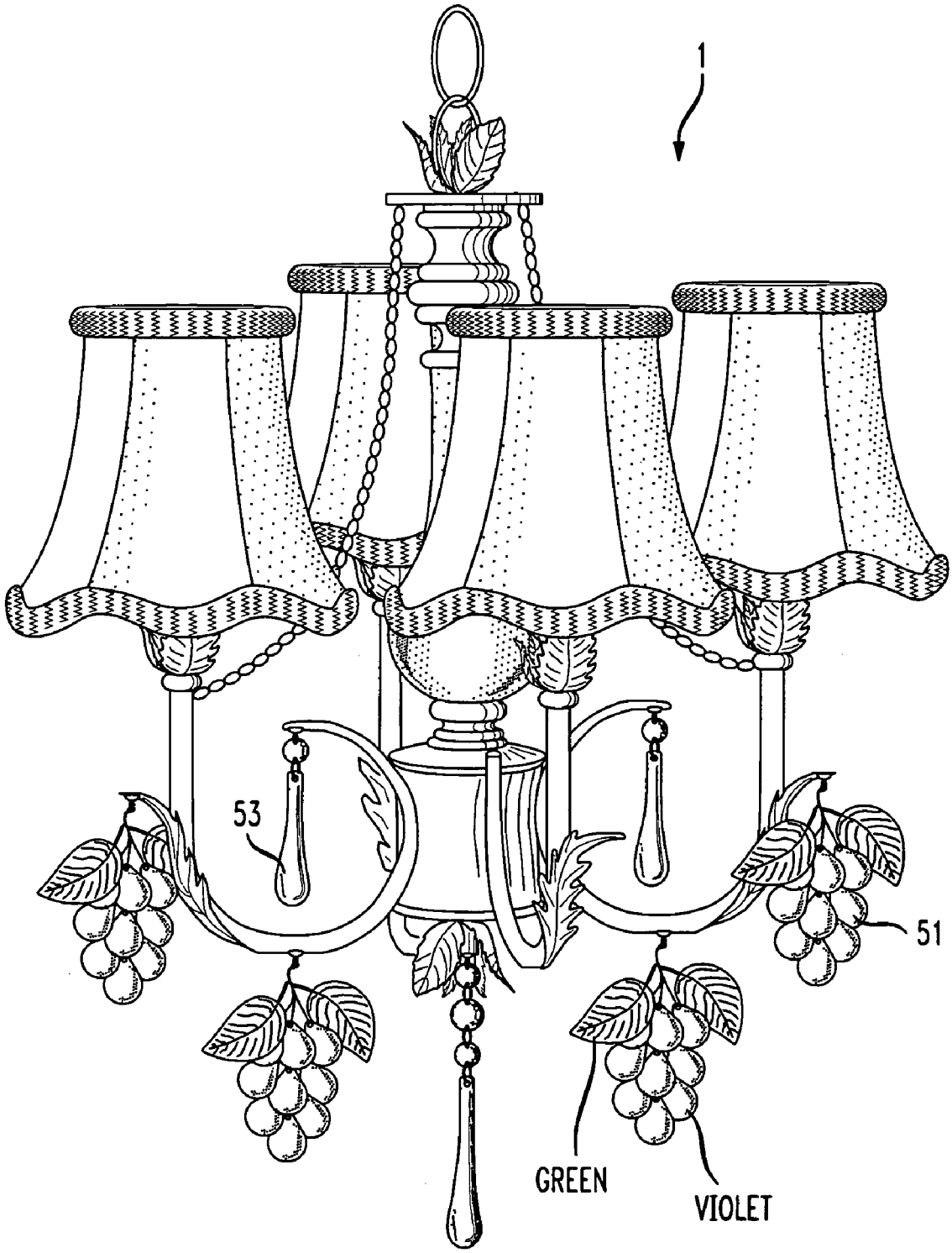
FIG. 6 illustrates another exemplary arrangement of the reconfigurable chandelier with interchangeable magnetic adornments according to the present invention.

FIG. 6 is another exemplary arrangement of chandelier 1 having a plurality of adornments consisting of adornments 51 and 53. Adornments 51 and 53 differ from one another and adornments 51 generally have the appearance of a bunch of grapes with a leaf.

Each of interchangeable magnetic adornments 11, 13 and 15 of FIG. 2; interchangeable magnetic adornments 21, 23, 25 and 27 of FIG. 3; interchangeable magnetic adornments 31, 33 and 35 of FIG. 4; interchangeable magnetic adornments 41, 43 and 45 of FIG. 5 and interchangeable magnetic adornments 51 and 53 of FIG. 6 include a magnet and are magnetically coupled to a fixed metallic portion of chandelier 1 at receiving locations 3. The appearance of chandelier 1 is thereby changed, as shown in FIGS. 1 through 6, by interchanging the interchangeable magnetic adornments. Although the interchangeable magnetic adornments are coupled to the same locations in FIGS. 2 through 6, it should be understood that such is exemplary only and in other embodiments, the interchangeable magnetic adornments may be coupled at different locations. Similarly, less than all of the original set of interchangeable magnetic adornments may be changed to provide a different appearance.

The use of the interchangeable magnetic adornments of the present invention in conjunction with a chandelier embodiment, is intended to be illustrative and exemplary, and not restrictive of the invention. In other exemplary embodiments, the interchangeable magnetic adornments may be used in conjunction with decorative lighting units, household lighting apparatuses and home accessories including, but not limited to candelabras, candle holders, ceiling fans, sconces, lampshades, lamps, finials, overhead light fixtures, strip or track lighting, curtain rods, decorative household cast iron, recessed lighting fixtures, bobeshes and other household appliances, furnishings and fixtures. Each of the exemplary embodiments may include metallic surfaces to which the interchangeable magnetic adornments may be coupled.

Figure 7:
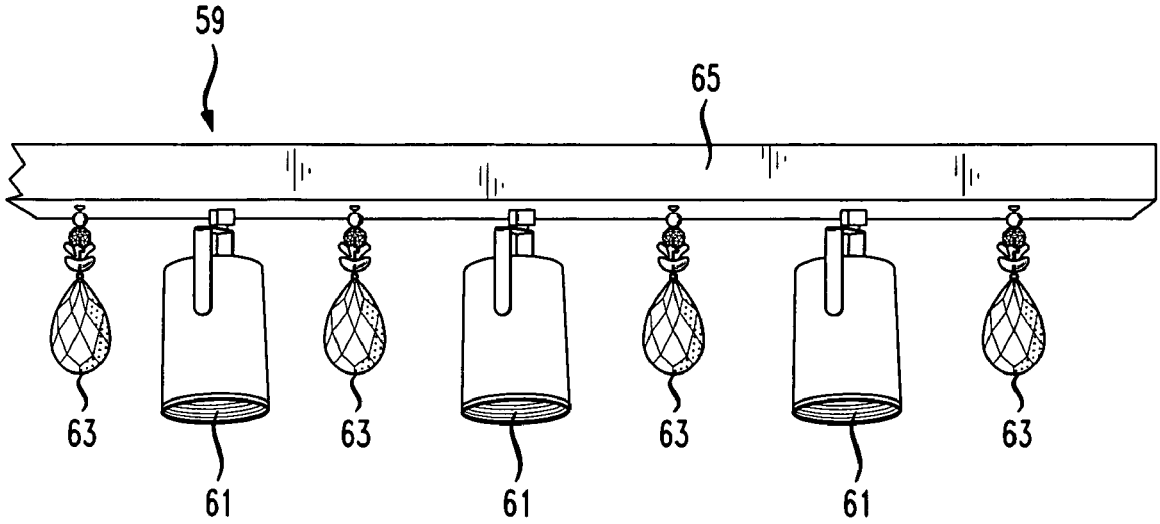
FIG. 7 illustrates an exemplary embodiment of an overhead light fixture with interchangeable magnetic adornments according to the present invention.

FIG. 7 is an exemplary embodiment of track or strip lighting 59 and includes strip 65 to which a plurality of light fixtures 61 is attached. Strip 65 may be attached to a ceiling or wall or other household surface. Interchangeable magnetic adornments 63 are attached at various locations to magnetic surface 65.

The present invention provides multiple embodiments of the interchangeable magnetic decorative adornments for attachment to reconfigurable decorative lighting units. The adornments are interchangeable and include at least one decorative portion and a magnet and are attachable to a plurality of corresponding metal portions of at least one decorative lighting unit.

Exemplary interchangeable magnetic decorative adornments are shown in FIGS. 8–12. The adornments include at least one magnet for coupling the adornment to a metallic receiving surface and one or more decorative pieces coupled to the magnet. The decorative pieces may be formed of crystal, plastic, mirror, glass, various polymeric materials, and other translucent, reflective or opaque materials. The adornment may be formed of multiple pieces or a single piece. The pieces or single piece may be coupled to each other and the magnet using string, fishing line, wire, metal links, metal chains or other suitable coupling means. In one embodiment, the multiple pieces may be vertically coupled to form a substantially symmetrical adornment such as shown in FIGS. 8–11. According to other exemplary embodiments, the adornments may have other appearances.

Figure 8:
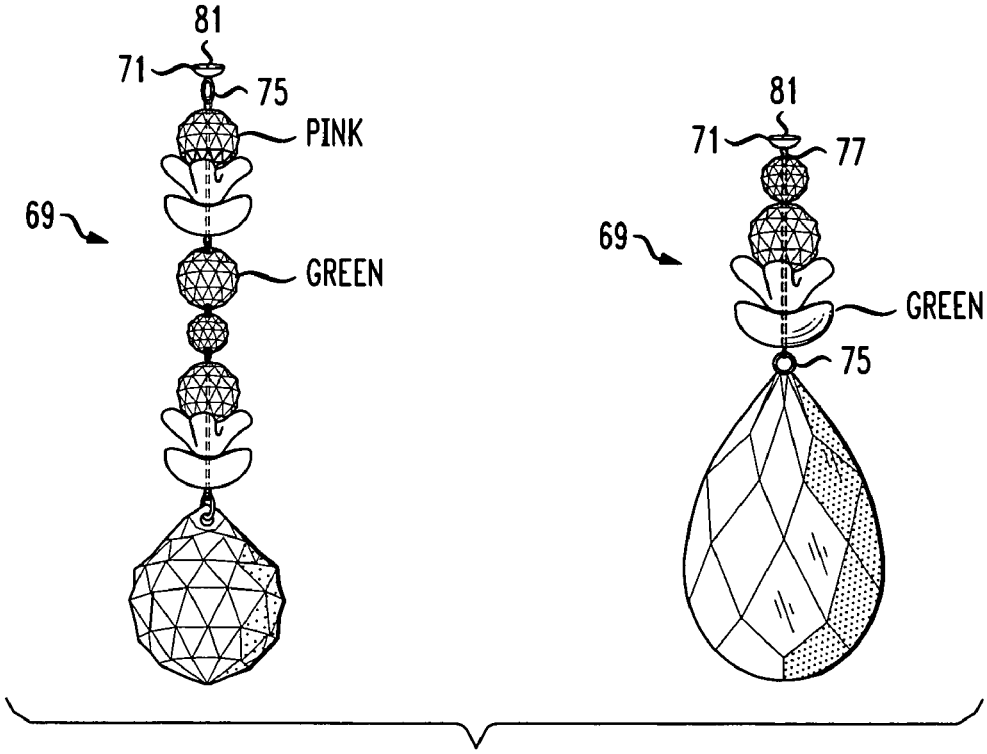
FIG. 8 illustrates two exemplary interchangeable magnetic adornments of the present invention.
Figure 9:
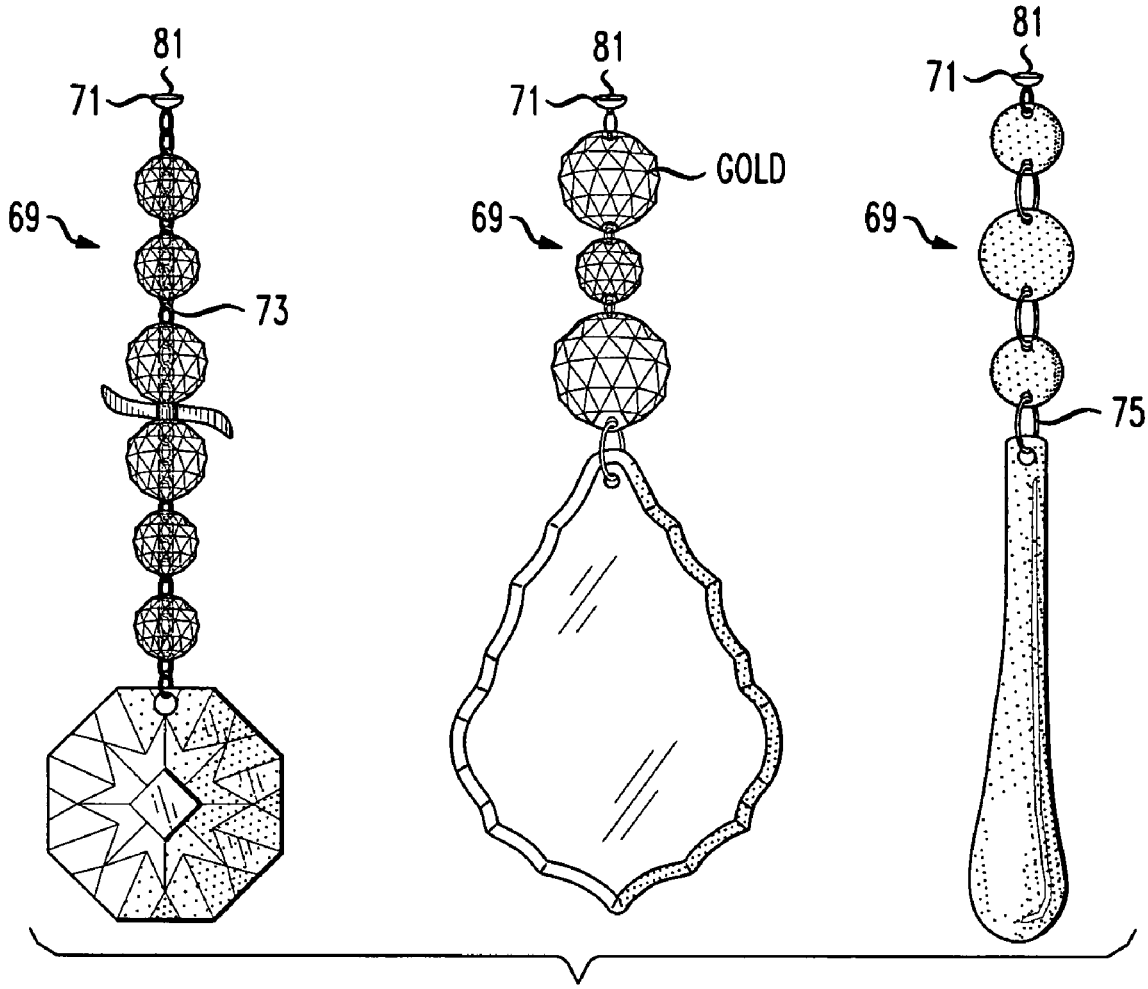
FIG. 9 illustrates three further exemplary interchangeable magnetic adornments of the present invention.

FIG. 8 shows two exemplary interchangeable magnetic adornments of the present invention. Similarly, FIG. 9 shows three more exemplary interchangeable magnetic adornments. Interchangeable magnetic adornments 69 each include magnet 71 by means of which adornment 69 is coupled to a metal portion. The multiple pieces that constitute adornments 69 may be coupled to one another and/or to magnet 71 by various means such as chain 73, metal links 75, string or wire 77, or other means. Although each magnet 71 is shown to have a generally flat coupling surface 81 and a generally round body, such hemispherical shape is intended to be exemplary only. It can be seen that each of the different exemplary adornments shown in FIGS. 8, 9, 10, 11 and 12 have different appearances including different shapes, colors and sizes, and different arrangements of components having different shapes, sizes and colors.

Figure 10:
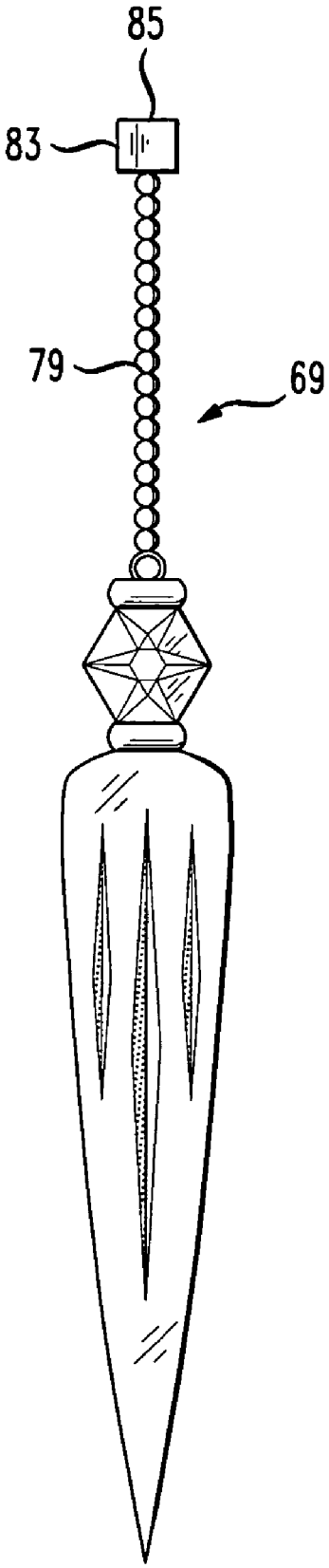
FIG. 10 illustrates yet another exemplary interchangeable magnetic adornment of the present invention.
Figure 11:
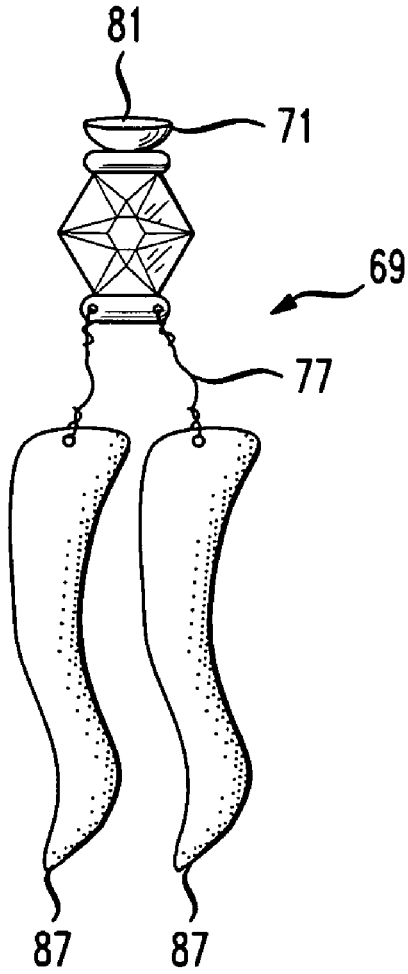
FIG. 11 illustrates another exemplary interchangeable magnetic adornment of the present invention.
Figure 12:
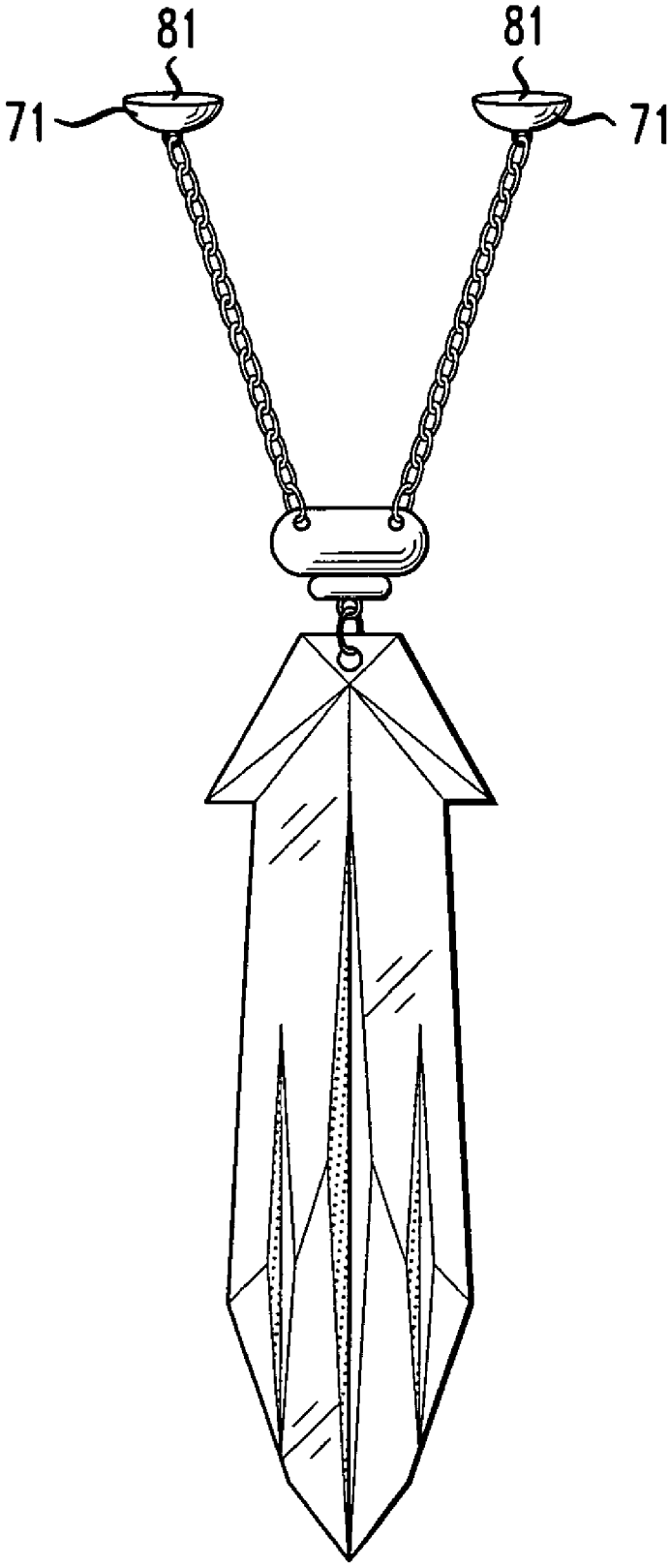
FIG. 12 illustrates yet another exemplary interchangeable magnetic adornment of the present invention.

FIG. 10 shows an exemplary adornment 69 in which a lengthy chain 79 is used to couple components of the adornment to magnet 83, which is generally rectangular and includes planar coupling surface 85. FIG. 11 shows another exemplary adornment of the present invention that includes lateral portions. Pieces 87 are coupled by string or wire 77 to other portions of adornment 69 and are disposed laterally with respect to one another. FIG. 12 shows another exemplary embodiment that includes two magnets 71 that are each generally hemispherical in shape and include a flat coupling surface 81.

The illustrated adornment arrangements are intended to be exemplary only and one of skill in the art could easily recognize that many variations of the exemplary adornments may be used. For example, the adornments may include ornamental designs such as flowers. The shapes of the illustrated magnets are intended to be exemplary as well.

The previously illustrated magnets that couple the interchangeable magnetic adornments to the chandelier or other fixture or appliance, may be coupled to the other piece or pieces that make up the decorative adornment by string, fishing line, wire, a chain, metal links, or other suitable coupling means. In one exemplary embodiment, the magnet may include a hole extending therethrough and which receives the wire, fishing line, string or other coupling means. The magnets may take on various shapes. In addition to the previously illustrated generally hemispherical (FIGS. 8, 9, 11 and 12), rectangular (FIG. 10) shapes, the magnets may take on other regular or irregular shapes. The magnets include a coupling surface such as surfaces 81 and 85 for coupling to a metallic receiving surface of the chandelier or other fixture or appliance. The coupling surface of the magnet may be substantially flat, concave, convex, or beveled; it may include multiple, substantially flat surfaces; or it may be multi-contoured. The magnets may include a superior magnetic strength and are chosen to easily bear the weight of the adornment which they support. Conventional magnets may be used, as well as rare earth magnets, ceramic magnets, or other magnets formed of various and sufficiently strong magnetic materials. In an exemplary embodiment, the magnets may be formed of neodymium iron boron (NdFeB or NIB), samarium cobalt (SmCo), Alnico or other ceramic or ferrite materials.

The metallic receiving portion of the chandelier or other household unit may be a horizontal surface, or it may be a surface angled with respect to the horizontal or vertical. Receiving locations 3, as previously illustrated, include such a metallic receiving surface. Various metals may be used for the metallic receiving surface. In one exemplary embodiment, the metallic receiving surfaces may be sized and shaped substantially similar to the corresponding engaging surfaces of the magnets. In other exemplary embodiments, a continuous metallic strip or other surface may be provided so that the interchangeable magnetic adornments may be coupled variously and not limited to particular locations.

Another aspect of the invention is that the interchangeable magnetic adornments may be used interchangeably between a chandelier and other fixtures, furnishings and/or appliance embodiments listed above. According to another exemplary embodiment, the interchangeable magnetic adornments may be interchanged between other fixtures, furnishings and appliance previously discussed.

The present invention also provides a method for cleaning chandeliers. The method includes forming a chandelier that includes removable portions, such as the magnetically coupled interchangeable adornments described herein. The removable portions may be disengaged by simply pulling to disengage the magnet. They may be removed by hand or by using various suitable gripping tools to disengage the magnet from the corresponding metal surface(s), then cleaned and restored to the chandelier. An extendable gripping tool, or other device which allows a user to grip and pull an overhead member, may be used. The individual, removed portions of the chandelier (the interchangeable magnetic adornments) may be cleaned separately or collectively.

Another aspect of the present invention is a method for changing the appearance and configuration of a chandelier by simply and quickly removing and replacing certain portions without requiring a painstaking and time-consuming disassembly/assembly procedure. The method includes providing a chandelier with removable portions. In one exemplary embodiment, the removable portions may be interchangeable magnetic adornments. A first set of interchangeable magnetic adornments may be disposed on the chandelier to provide a first appearance. The first plurality of decorative interchangeable magnetic adornments may be removed by pulling to disengage the magnet. This may be done by hand or by using a gripping tool or other device which allows a user to grip and pull an overhead member. A second set of decorative interchangeable magnetic adornments may then be interchanged and positioned on the chandelier. In another exemplary embodiment, only some of the first plurality of decorative adornments may be replaced, that is, interchanged. According to another exemplary embodiment, the chandelier may include multiple metallic receiving surfaces, and the first plurality of interchangeable magnetic adornments may be simply repositioned to other of the metallic receiving surfaces to provide a different appearance and configuration of the chandelier. In yet another exemplary embodiment in which the chandelier includes various metallic coupling surfaces, the first plurality of adornments may be retained in place, and the second plurality of adornments may be added to provide a fuller appearance of the chandelier.

It should be understood that the previous techniques for cleaning a chandelier and for changing the configuration of the chandelier are intended to be illustrative and exemplary of the uses of the interchangeable magnetic adornments of the present invention, and are not intended to be limiting. In other exemplary embodiments, the present invention provides for any of the various other fixtures and appliances described above to include interchangeable magnetic adornments which may be removed for cleaning as described above or which may be interchanged or rearranged as described above in conjunction with the chandelier example.

An advantage of the present invention is that an elaborate disassembly/reassembly process is not required for cleaning or changing the appearance of the chandelier or other fixture or appliance. Rather, the interchangeable magnetic adornments are easily removable by simply pulling. Stated alternatively, the magnetically coupled adornments become disengaged by simply applying enough force to overcome the magnet strength, and then reattached by bringing the magnet in contact with the corresponding metal receiving surface.

The preceding merely illustrates the principles of the invention. It will thus be appreciated that those skilled in the art will be able to devise various arrangements which, although not explicitly described or shown herein, embody the principals of the invention and are included within its spirit and scope. Furthermore, all examples and conditional language recited herein are principally intended expressly to be only for pedagogical purposes and to aid the reader in understanding the principals of the invention and the concepts contributed by the inventors to furthering the art, and are to be construed as being without limitation to such specifically recited examples and conditions. Moreover, all statements herein reciting principals, aspects, and embodiments of the invention, as well as specific examples thereof, are intended to encompass both structural and functional equivalents thereof. Additionally, it is intended that such equivalents include both currently known equivalents and equivalents developed in the future, i.e., any elements developed that perform the same function, regardless of structure.

This description of the exemplary embodiments is intended to be read in connection with the figures of the accompanying drawing, which are to be considered part of the entire written description. In the description, relative terms such as "lower," "upper," "horizontal," "vertical,", "above," "below," "up," "down," "top" and "bottom" as well as derivatives thereof (e.g., "horizontally," "downwardly," "upwardly," etc.) should be construed to refer to the orientation as then describe or as shown in the drawing under discussion. These relative terms are for convenience of description and do not require that the structure be constructed or operated in a particular orientation.

Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

The invention claimed is:

1. A reconfigurable apparatus comprising at least one fixed component, and a plurality of interchangeable decorative adornments magnetically coupled to said apparatus simultaneously, wherein each of said interchangeable decorative adornments is attachable anywhere on a continuum of non-fixed locations of said apparatus to provide multiple configurations to said apparatus and said apparatus comprises a chandelier comprising a hanging branched lighting fixture including a frame and a plurality of light sources.

2. The reconfigurable apparatus as in claim 1, wherein said plurality of interchangeable decorative adornments comprise a first set of interchangeable decorative adornments that provide a first appearance to said apparatus when simultaneously coupled to said apparatus and further comprising a second set of interchangeable decorative adornments magnetically engageable with said apparatus to provide a second appearance when simultaneously coupled to said apparatus.

3. The reconfigurable apparatus as in claim 1, wherein said plurality of interchangeable decorative adornments include interchangeable decorative adornments of at least one of different colors and different shapes.

4. The reconfigurable apparatus as in claim 1, wherein said plurality of interchangeable decorative adornments include at least one interchangeable decorative adornment formed of crystal.

5. The reconfigurable apparatus as in claim 1, wherein each of said plurality of interchangeable decorative adornments hangs from a single connection point.

6. The reconfigurable apparatus as in claim 5, wherein each said interchangeable decorative adornment hangs from a single magnet.

7. The reconfigurable apparatus as in claim 1, wherein said at least one fixed component comprises a frame and said continuum of non-fixed locations comprise exposed metallic surfaces capable of receiving any of said interchangeable decorative adornments anywhere thereon.

8. A reconfigurable chandelier comprising a hanging branched lighting fixture including a frame with a continuous metal surface, at least one light and a plurality of interchangeable decorative adornments, each including a magnet, said plurality of interchangeable decorative adornments being magnetically coupled to said chandelier simultaneously, each of said plurality of interchangeable decorative adornments being attachable anywhere on said continuous metal surface.

9. The reconfigurable chandelier as in claim 8, wherein said plurality of interchangeable decorative adornments includes interchangeable decorative adornments of at least one of different colors and different shapes.

10. The reconfigurable chandelier as in claim 8, wherein at least one said interchangeable decorative adornment includes a crystal portion.

11. The reconfigurable chandelier as in claim 8, wherein at least one said interchangeable decorative adornment includes a plurality of decorative portions having at least one of a different shape and a different color.

12. The reconfigurable chandelier as in claim 8, wherein each said magnet is coupled to a decorative portion that hangs therefrom by one of string, wire, metal links and a metal chain.

* * * * *